US006997715B2

(12) United States Patent
Perry et al.

(10) Patent No.: US 6,997,715 B2
(45) Date of Patent: Feb. 14, 2006

(54) INTEGRATED EVALUATION AND SIMULATION SYSTEM FOR GROUND COMBAT VEHICLES

(75) Inventors: John S. Perry, Afton, MN (US); David A. Cooper, Maple Grove, MN (US)

(73) Assignee: United Defense, L.P., Arlington, VA (US)

( * ) Notice: Subject to any disclaimer, the term of this patent is extended or adjusted under 35 U.S.C. 154(b) by 343 days.

(21) Appl. No.: 10/115,590

(22) Filed: Apr. 2, 2002

(65) Prior Publication Data

US 2002/0150866 A1 Oct. 17, 2002

Related U.S. Application Data

(63) Continuation-in-part of application No. 09/824,512, filed on Apr. 2, 2001.

(51) Int. Cl.
*F41A 33/00* (2006.01)

(52) U.S. Cl. ..... 434/11; 703/6; 703/13

(58) Field of Classification Search ..... 434/11
See application file for complete search history.

(56) References Cited

U.S. PATENT DOCUMENTS

| | | | | |
|---|---|---|---|---|
| 4,705,477 A | | 11/1987 | Komorowski et al. | |
| 4,926,362 A | | 5/1990 | Carns et al. | |
| 5,303,170 A | | 4/1994 | Valko | |
| 5,415,548 A | | 5/1995 | Adams | |
| 5,427,531 A | | 6/1995 | Kramer | |
| 5,661,668 A | | 8/1997 | Yemini et al. | |
| 5,719,797 A | | 2/1998 | Sevachko | |
| 5,844,819 A | | 12/1998 | Fujinuma | |
| 6,106,298 A | * | 8/2000 | Pollak | 434/29 |
| 6,167,360 A | | 12/2000 | Erickson et al. | |
| 6,208,955 B1 | | 3/2001 | Provan et al. | |
| 6,411,945 B1 | * | 6/2002 | Nakajima | 706/19 |
| 6,567,087 B1 | * | 5/2003 | Reid | 345/428 |

FOREIGN PATENT DOCUMENTS

WO WO 0023934 4/2000

OTHER PUBLICATIONS

Dubin, Henry; Sebastiani, Lambert; Staniec, Cyrus. High Performance Computing Workshop 1999 "Integrated Modeling and SImulation into the US Army Operational Test and Evaluation Process" 1998, pp. 1-9. www.dtc.army.mil/hpcw/1998/sebast/sebast.html.*

(Continued)

*Primary Examiner*—Xuan M. Thai
*Assistant Examiner*—Cameron Saadat
(74) *Attorney, Agent, or Firm*—Patterson, Thuente, Skaar & Christensen, P.A.

(57) ABSTRACT

An integrated evaluation and simulation system for ground combat vehicles interactively evaluates concept design decisions and design requirements in the context of an operational ground combat vehicle. The combat effectiveness of a ground combat vehicle may also be concurrently tested by virtual simulation. A computer system is programmed to implement a causal network model comprising an integrated collection of analysis models for creating a virtual representation of a ground combat vehicle. The integrated evaluation and simulation system includes a user interface operatively coupled to at least the computer system to selectively input data into the causal network model and receive information therefrom, and at least one virtual simulation system. The system can further include either a virtual simulation system operatively coupled to the causal network model or, as part of the computer system, a virtual simulation system interface to communicate with a separate virtual simulation system.

1 Claim, 13 Drawing Sheets

OTHER PUBLICATIONS

Carico, Dean. High Performance Computing Workshop 1998 "Flight Test Automation Using High Performance Computing" Naval Air Warfare Center Aircraft Division. 1998, pp. 1-9. www.dtc.army.mil/hpcw/1998/carico/carico.html.*

Allred, L.G. Aerospace and Electronics Conference, 1990. NAECON 1990., Proceedings of the IEEE 1990 National , May 21-25, 1990 Page(s): 359-361 vol. 1.*

Oswalt, Ivar, Technology Trends in Military Simulation winter 1995, CACI Products Company—Simulation Projects Division, pp. 1152-1157.*

Jacobson (Propulsion System Performance Simulation (PS**2) Computer Simulation to Evaluate Tank-Automotive Engine and Transmission Performance)—discloses a Vehicle simulator, Sep. 1988,U.S. Army Tank-Automotive Command R & D & Engineering Center.*

*Executing the DoD Modeling and Simulation Strategy-Making Simulation Systems of Systems a Reality*, James W. Hollenbach, William L. Alexander, Proceedings of the 1997 Winter Simulation Conference, pp. 948-954, 1997.

*An Example of Simulation Use in Army Weapon System Development*, Ann H. Kissell, Proceedings of the 1999 Winter Simulation Conference, pp. 1079-1087, 1999.

*System Concept Development With Virtual Prototyping*, James C. Schaaf, Jr., Proceedings of the 1997 Winter Simulation Conference, pp. 941-947, 1997.

*Advanced Simulation, Battle Managers, and Visualization*, Joseph J. Molitoris, Thomas D. Taylor, Proceedings of the 1995 Winter Simulation Conference, pp. 1168-1175, 1995.

*Modeling and Simulation Enabling Technologies for Military Applications*, Alex S. Sisti, Steven D. Farr, Proceedings of the 1996 Winter Simulation Conference, pp. 877-883, 1996.

*Exploiting Temporal Uncertainty in Parallel and Distributed Simulations*, Richard M. Fujimoto, Georgia Institute of Technology, IEEE, pp. 46-53, 1999.

*An Integrated Approach to System Modeling Using a Synthesis of Artificial Intelligence, Software Engineering and Simulation Methodologies*, Paul A. Fishwick, University of Florida, ACM Transactions on Modeling and Computer Simulation, vol. 2, No. 4, pp. 307-330, Oct. 1992.

Web site print-out: *EPG Assets, the C4I Synthetic Battlefield Environment Lab* (*C4I SBEL*), 2 pgs., 2001.

Web site print-out: *EPG Assets, the Virtual Electronic Proving Ground* (*VEPG*), 2 pgs., 2001.

* cited by examiner

GROUNDWARS OUTPUT

GROUNDWARS SUMMARY

| | | | |
|---|---|---|---|
| BLUE VEHICLES | 4.000 | RED VEHICLES | 8.000 |
| BLUE VEHICLES KILLED | 3.372 | RED VEHICLES KILLED | 5.669 |
| FORCE EXCHANGE RATIO | 0.841 | LOSS EXCHANGE RATIO | 1.681 |

INTEGRATED EVALUATION AND SIMULATION SYSTEM FOR GROUND COMBAT VEHICLES

RELATED APPLICATIONS

This application is a continuation-in-part application of a co-pending nonprovisional application, Integrated Evaluation and Simulation System for Military Weapon Systems, Ser. No. 09/824,512, filed Apr. 2, 2001, and incorporated herein by reference.

FIELD OF THE INVENTION

The present invention relates generally to the field of simulating military weapon systems. In particular, the present invention relates to a system for aiding design work of complex military weapon systems by performing sophisticated design concept analyses and by simulating operations on virtual representations of ground combat vehicles interactively with the design work.

BACKGROUND OF THE INVENTION

The development of complex military equipment traditionally has been based on a rigid, top-down approach, originating with a publication of a customer operational requirements document. The prime contractor decomposes the operational requirements document to allocate requirements at the weapon system level, which in turn are further decomposed and allocated at the subsystem and component level. This top-down, hierarchical approach ensures that customer requirements are reflected in lower-level requirements and become integral to the objective weapon system design. This approach, however, does very little to optimally allocate limited resources across a weapon system design, and objective characteristics of an operational design often exceed program constraints. In addition to suboptimized designs, the top-down approach often leads to misallocated development resources and development processes that are incapable of rapidly responding to inevitable changes in operational, fiscal, and technological considerations.

Customer recognition of the above-described dilemmas, the realities of tight fiscal budgets, and changes in the geopolitical climate during the past decade have had a noticeable philosophical effect on how future weapon systems can be developed and procured. The development of future weapon systems will be cost constrained so that a weapon system's capabilities will be partially determined by a customer's ability to procure funding. In addition, most forces are no longer forward deployed, but instead are forward deployable. The ability to project force around the world, and the ability to sustain a force outside a customer's sovereign territory, has placed a tremendous burden on the logistical operations of customers. For example, providing fuel for equipment to an extended force is by far one of the greatest logistical challenges. Another is carrying or transporting this equipment for use by the extended force. These demands can be cut significantly by reducing the weight of the equipment either by using lighter or smaller equipment. In essence, the importance of weapon system weight has been elevated to the same level as weapon system cost. Total weapon system cost and weight have become limiting resources to the development of future military weapon systems.

In response to these fiscal and geopolitical changes, some customers have established a mission need and a partial list of non-negotiable, operational requirements for future weapon systems. These customers also have requested prospective weapon system developers to design, develop, and demonstrate credible simulated modeling approaches to satisfying operational weapon system requirements and to developing weapon system designs that allocate constrained resources and optimize performance according to specified measures of effectiveness.

Previous efforts to develop software for weapon systems have focused on stand alone simulation software or software that provides analysis at the subsystem or component level only, because methods such as the above-described top-down approach were used to manage the overall design and development process. For example, R. Carnes et al., U.S. Pat. No. 4,926,362, Airbase Sortie Generation Analysis Model (ABSGAM), describes a computer simulation model for analyzing the sortie generation capabilities and support requirements of air vehicle designs and for performing effectiveness analyses on these designs. The model cannot be used to allocate resources across a system or various subsystems or components of a design nor used concurrently and interactively with design work. Another similar invention is described by R. Adams, U.S. Pat. No. 5,415,548, System and Method for Simulating Targets for Testing Missiles and Other Target Driven Devices.

It would be advantageous to have an evaluation and simulation system that functions integrally and interactively with the conceptualization, design, and development of weapon systems, and particularly ground combat vehicles, under conditions whereby design concepts can be analyzed, constrained resources can be allocated across a weapon system architecture in a manner that optimizes the weapon system's combat effectiveness, and a virtual representation of the weapon system can be tested under simulated combat conditions for combat effectiveness. Moreover, it would be advantageous if a user of such an evaluation and simulation system could establish performance levels for operational, system, subsystem, and component requirements, while optimizing the ground combat vehicle's combat effectiveness and satisfying the resource constraints.

SUMMARY OF THE INVENTION

An integrated evaluation and simulation system for ground combat vehicles interactively evaluates concept design decisions and design requirements in the context of an operational ground combat vehicle. The combat effectiveness of a ground combat vehicle may also be concurrently tested by virtual simulation. A computer system is programmed to implement a causal network model comprising an integrated collection of analysis models for creating a virtual representation of a ground combat vehicle. The integrated evaluation and simulation system includes a user interface operatively coupled to at least the computer system to selectively input data into the causal network model and receive information therefrom, and at least one virtual simulation system. The system can further include either a virtual simulation system operatively coupled to the causal network model or, as part of the computer system, a virtual simulation system interface to communicate with a separate virtual simulation system.

Preferred embodiments of the present invention relate to an integrated evaluation and simulation system for ground combat vehicles for concurrently and interactively evaluating the benefits and burdens of concept design decisions and design requirements with design work. The combat effectiveness of a ground combat vehicle built according to a set of design parameters also can be concurrently tested by virtual simulation. Thus, the present invention enables a system designer to efficiently, comprehensively, interactively, and concurrently evaluate and optimize overall ground combat vehicle performance by manipulating basic system design inputs and parameters. For example, the present invention can be linked to Pro-Engineer™ for refining initial conceptual designs. The invention is easily adapted to a wide variety of analyses, including sensitivity and trade-off analysis, dependencies analysis, and optimization analysis based on predetermined resource constraints.

Preferred embodiments of the integrated evaluation and simulation system for ground combat vehicles include a computer system programmed to implement a computational engine having a causal network model factoring at least one interrelationship among a plurality of critical combat effectiveness functional attributes and constrained resources for a ground combat vehicle, and programmed to create a virtual representation of the ground combat vehicle. The causal network model is capable of creating a virtual representation that is optimally combat effective in terms of lethality or survivability effectiveness given the probability of being hit or probability of being killed. The computational engine also includes a control system that preferably is at least partly based on gradient search methodology, wherein the control system pulses the causal network model until each of the dependent variables, generally the design parameters of a ground combat vehicle, converge to within a predetermined error percentile. The preferred embodiments may also include at least one virtual simulation system operatively coupled to the computational engine to simulate a ground combat vehicle, and a user interface operatively coupled to at least the computer system to selectively input data into and receive information from the computational engine. The computer system may also communicate with the at least one virtual simulation system and receive information from the virtual simulation system in other ways to be described herein.

The combat effectiveness attributes of a ground combat vehicle include the attributes of mobility, lethality, survivability, C4I/Crew, cost, and weight. (The term "C4I/Crew" refers to command, control, communication, computers, and intelligence as these are used by crew to understand a battlefield environment.) The effects of these attributes can be observed by running a Ground Wars Combat Effectiveness Model simulation (GroundWars), an ARTQUIK artillery simulation, or a NATO Reference Mobility Model II simulation, which simulations can include force-on-force combat, or proprietary virtual environment software. The computational engine has at least one causal network model and implements a modular software architecture down to a vehicle's component level, so that each module can be represented by a separate subroutine. The user interface has a menu driven graphical user interface with a quickview window feature for depicting a two- or three-dimensional virtual representation of a ground combat vehicle.

Preferred embodiments of the integrated evaluation and simulation system are based on several performance criteria: system usability, system modularity, system speed, and system accuracy. Usability is defined as the level of accessibility to input data and output information, and the level of user friendliness of the user interface design. All input and output is accessible to the user via a graphical user interface and/or data files. A user is not encumbered with "window confusion," i.e., having too many windows open simultaneously, as preferred embodiments allow for no more than six windows to be open concurrently.

The integrated evaluation and simulation system are easy to maintain and upgrade because it has a modular software design. Preferred embodiments use a modular subroutine for each "node" within the causal network model to facilitate the maintenance, removal, and replacement of each "black-box" for each node, as the need arises, without disrupting the balance of the system. Thus, a visual representation of the causal network model and the software should exhibit commonality.

Computational speed is defined for each mode of operation. In the single-run mode, which involves propagating all inputs through the causal network model and into GroundWars, 2 minutes or less is required. In the dependencies mode, a run time of less than 10 seconds is required. In the sensitivities mode, a run time of 15 seconds or less is required for non-GroundWars runs consisting of at least 10 increments of the independent variables. For sensitivity runs consisting of at least 10 increments of the independent variables and that include GroundWars execution, a run time of 20 minutes or less is required. In the optimization mode, a run time of 1 hour or less for 6 independent variables is acceptable, and a run time of 2 days or less is acceptable for global optimization. These times are established for output having a computational error that does not exceed a predetermined percentile for any single computed variable, preferably ten percent, when compared to actual test data.

The present invention also includes a method of integrated evaluation and simulation, for allocating resources across a system architecture of a ground combat vehicle to optimize the ground combat vehicle's combat effectiveness, by providing a computer system having a user interface and a computational engine having a causal network model factoring an interrelationship among a plurality of critical combat effectiveness attributes for the ground combat vehicle; by providing at least one virtual simulation system; by selectively inputting data into the computational engine to create a virtual representation of an optimally effective ground combat vehicle; by selectively running the virtual representation of the optimally effective ground combat vehicle in the at least one virtual simulation system; and by utilizing information obtained from the simulation run to enhance the virtual representation of the optimally effective ground combat vehicle.

The computer system alternatively can be described as having a computer-readable storage media storing at least one computer program that operates as an integrated evaluation and simulation system for allocating resources across a system architecture of a ground combat vehicle to optimize the ground combat vehicle's combat effectiveness. This implementation is accomplished by storing a computational engine having a causal network model factoring at least one interrelationship among a plurality of critical combat effectiveness attributes in the computer system; by obtaining data necessary for the program to create a virtual representation of an optimally effective ground combat vehicle; by running the computational engine to create the virtual representation of the optimally effective ground combat vehicle; by selectively sending the virtual representation to a virtual simulation system for simulating an operation of said ground combat vehicle; and by receiving information about the simulated operation of the ground combat vehicle.

DESCRIPTION OF THE PREFERRED EMBODIMENT

The preferred embodiment of the present invention implements an integrated evaluation and simulation computer system for ground combat vehicles that addresses the fundamental question regarding how to allocate limited resources, such as cost and weight resources, across a system architecture of a ground combat vehicle in a manner that optimizes the weapon system's combat effectiveness. The integrated evaluation and simulation system allows a user to establish performance levels for operational, system, subsystem, and component requirements, leading to optimal equipment design, as measured by a ground combat vehicle's combat effectiveness and given the resource constraints. The integrated evaluation and simulation system is capable of concurrently and interactively modeling the performance and constrained resource parameters of a ground combat vehicle and simulating the ground combat vehicle's combat effectiveness on a virtual simulation system. The integrated evaluation and simulation system implements a modular software architecture down to the equipment component level and can be operated by selectively using a menu driven graphical user interface.

The integrated evaluation and simulation system preferably can be run in any of four different modes: a single-run mode, which propagates specified inputs once through the causal network model; a dependencies mode, which identifies all parameters downstream from any input parameter; a sensitivities mode, which provides a venue for performing sensitivity and trade-off analysis between any variables within the causal network model; and an optimization mode, which optimizes combat effectiveness for specified constrained resources at the local or global level, i.e., the component, subsystem, or system levels. The integrated evaluation and simulation system also can perform sensitivity analysis between the operational performance of the ground combat vehicle and the system, subsystem, or component requirements; design attributes; or performance attributes of the ground combat vehicle. The user interface has a level of user friendliness that is acceptable to engineers, analysts, and project managers and can be linked to Pro-Engineer™ for refining initial conceptual designs.

Figure 1:
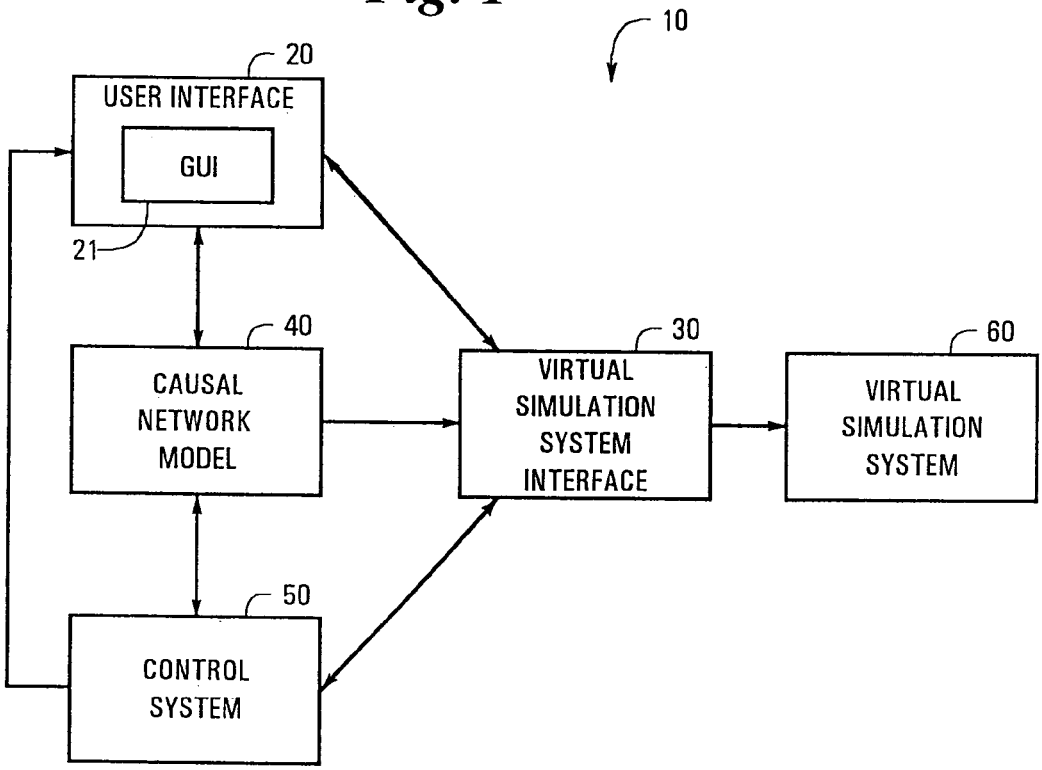
FIG. 1 is a diagram of the system architecture of the integrated evaluation and simulation system.

As shown in FIG. 1, a system architecture 10 of the present invention includes a user interface 20, having a menu driven graphical user interface 21, a virtual simulation system interface 30, a causal network model 40, a control system 50, and at least one virtual simulation system 60. Preferably, the user interface 20 bi-directionally communicates with the virtual simulation system interface 30 and the causal network model 40, the causal network model 40 bi-directionally communicates with the control system 50 and communicates to the virtual simulation system interface 30, the control system 50 bi-directionally communicates with the virtual simulation system interface 30 and communicates to the user interface 20, and the virtual simulation system interface 30 bi-directionally communicates with the virtual simulation system 60.

The causal network model 40 performs all the computations required by the user interface 20, the virtual simulation system interface 30, and the control system 50 and provides a means for analyzing the complex interactions and interrelationships within the ground combat vehicle under study. The causal network model 40 creates a virtual representation of the ground combat vehicle under study that encompasses the critical combat effectiveness functional attributes of the ground combat vehicle. Each functional attribute is implemented to a level that supports an assessment of performance and the constrained resources. The causal network model 40 also can create a "threat" or "red" virtual representation to match the threat's performance characteristics against a "blue" ground combat vehicle, and to compare this match up as the blue weapon system's performance characteristics are changed. The causal network model is highly modular. Examples of component models include, but are not limited to, for ammunition, projectile sizing for armor piercing fin stabilized discarding sabot (APFSDS) and high explosive/fragmentation, overall round sizing, and lethal area estimation; for cannons, monoblock gun tube and autofrettaged gun tube determination; for missiles, internally and externally stowed and horizontal and vertical launch orientations; for gun mounts; for crew, seated and reclined posture determination and troop carrier potential; for pulse forming networks, temperature compensation effects upon ballistic performance and pulse forming network mass and volume; for power train, diesel or turbine determination, engine mass and volume estimations, and transmission, cooling system, filtration system, exhaust system, battery system, and fuel system determination; for turrets, mass and volume based upon size and location of interior components, variable ready magazine location, autoloader or manual loading determination, rate of fire calculations, and elevation and azimuth drive determination; for hull, conventional and novel armor determination and mass and volume based upon size and location of interior components, variable layout for a crew, powerplant, and turret locations; for suspension, both tracked and wheeled; and for system center of gravity and moments of inertia. Performance models include, but are not limited to, for mobility, maximum cross country speed; for interior ballistics, muzzle velocity for APFSDS and high explosive/fragmentation rounds; for exterior ballistics, detailed trajectory model-APFSDS round and maximum range estimation; for accuracy, calculations for average projectile dispersion as a function of range to target for direct fire; for probability of hit, lethality and survivability effectiveness for red vs. blue and blue vs. red confrontations, accounting for target size, shape, and aspect; and for probability of kill, lethality and survivability effectiveness for red vs. blue and blue vs. red confrontations, accounting for obliquity and density of target armor, and determination for probability of kill to residual kinetic energy if armor is penetrated.

The user interface 20 allows a user to control all aspects of the system's behavior. A user may selectively control the preferred embodiment either from a command line or through the graphical user interface 21. When the command line is used, a user uses a text editor to directly edit input files as needed. The user then types the appropriate command to run the causal network model 40. Control is returned to the user at the command prompt when the run is completed. When the graphical user interface 21 is used, this interface interacts with the causal network model 40 on behalf of the user. The user interface 20 is a separate software program from the program holding the causal network model 40, as this separation facilitates implementing the control system 50, especially when the control system 50 utilizes a commercially available optimizer. As with other parts of the integrated evaluation and simulation system, the graphical user interface 21 is designed to be highly modular and easily modifiable and expandable. Input and output often used within a single working session has its own user interface panel, while input and output that is infrequently accessed, or accessed only after multiple working sessions, is accessible via data files. The graphical user interface detailed design preferably takes the form of a series of panel designs that contain the detail on behavior, functionality, and parameters accessible by the respective panels.

Figure 2:
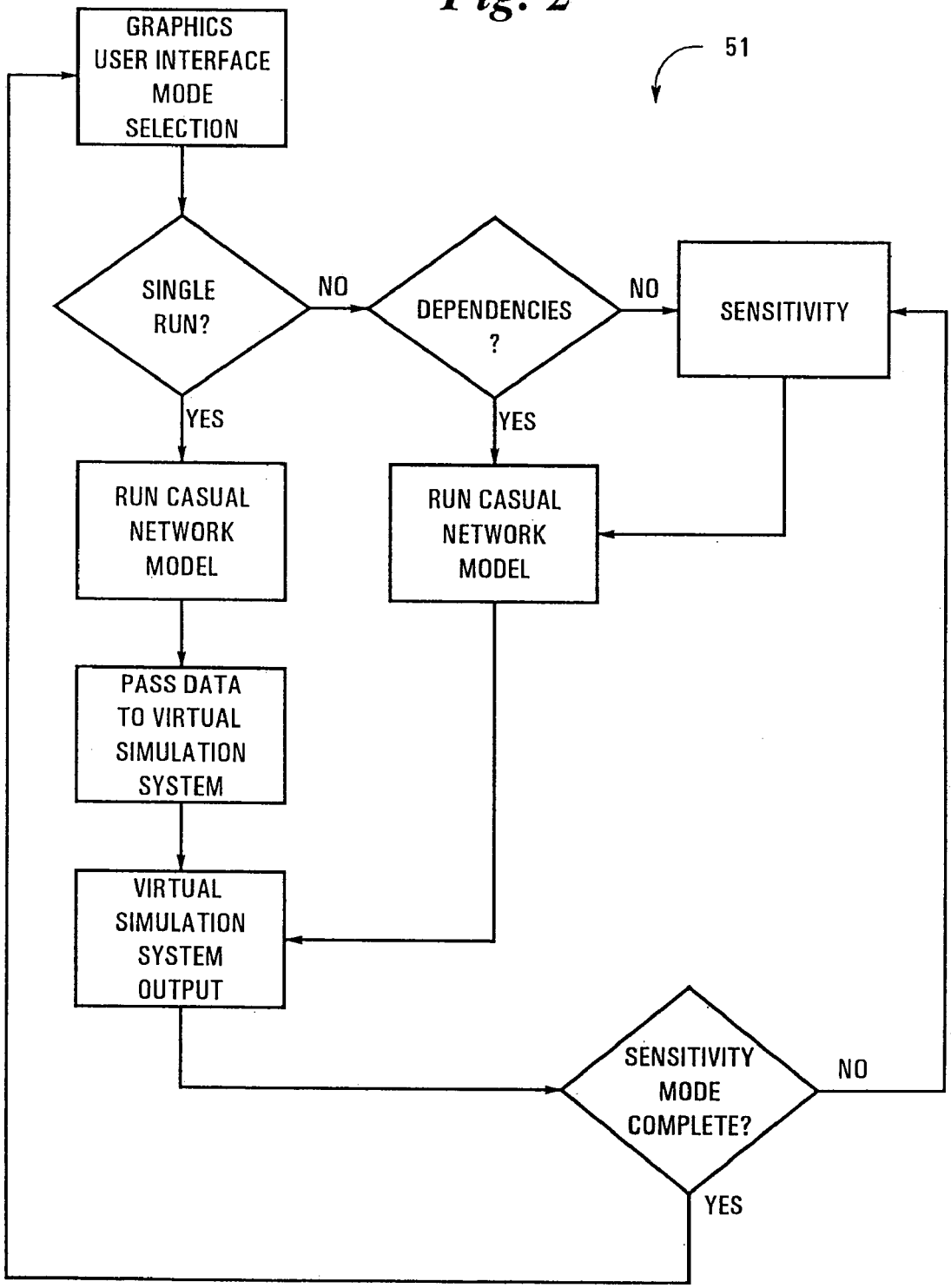
FIG. 2 is a diagram of the control system algorithm of the preferred embodiment.

A control system 50 is used to control the states and modes of operation of the invention and to control the optimization process that operates upon the causal network model 40. The control system 50 is preferably at least partly based on gradient search methodology, and the optimization process may be a commercially available product. A control system algorithm 51, as illustrated in FIG. 2, controls the integrated evaluation and simulation system 10 in the single-run, dependencies, and sensitivities modes of operation. The optimization mode is achieved by using special algorithms to pulse the causal network model 40 until each of the dependent variables converges to within acceptable limits.

A virtual simulation system interface 30 preferably serves as a conduit between the causal network model 40 and a virtual simulation system 60. When the virtual simulation system 60 is provided by a third party, the virtual simulation system interface 30 preferably is configured so that the virtual simulation system 60, other than possibly some driver functions, does not have to be modified. A virtual simulation system interface 30 for ground combat vehicles can be designed to act as a conduit between the causal network model 40 and the United States Army's GroundWars model while preserving GroundWar's accredited status. In addition, the virtual simulation system interface 30 returns data structures from a virtual simulation system 60 to the control system 50 and user interface 20. This information can include a summary of the results of a monte-carlo style simulation, vehicle acquisition statistics, a killer-victim scoreboard, a distribution of shots, and a loss exchange ratio. The virtual simulation system interface also serves as a link to proprietary virtual environment software.

The integrated evaluation and simulation system 10 has no adverse affects on its operational environment, including its hardware and software environment. The preferred embodiment of the present invention runs in a UNIX or LINUX operating environment and is accessible from any Sun or Silicon Graphics Incorporated (SGI) workstation; an SGI system is used to generate plots of analysis results. Those skilled in the art are aware that other present and future computing system platforms may be used to support the integrated evaluation and simulation system 10. The preferred embodiment is capable of creating three-dimensional plots and numerical tables.

Using the graphical user interface 21, a mode of operation selection is made via a mode of operation button on the main menu window. The single-run mode performs a single run through the causal network model 40, producing a set of intermediate and final results. Input variables can be changed one at a time or in any combination. The computational process begins when a run button is activated to propagate all of the input data through the entire causal network model 40.

The dependencies mode rapidly and visually identifies the interrelationships between design attributes and performance parameters within the causal network model 40. A user can select any input value and generate visual cues, for example check boxes, of all downstream parameters that would be affected by a change to this input. First, the control system 50 is initiated and the causal network model 40 is pulsed to identify the downstream parameters. Then the results are returned to the user interface 20.

The sensitivities mode is designed to evaluate weapon system performance in terms of any design parameter in the causal network model 40. When this mode is selected, any input design parameter (independent variable) can be varied to evaluate the effects on any performance parameter (dependent variable). The control system 50 performs multiple single-run passes through the causal network model 40, varying the selected input variable according to the range and increment specified by the user. The results of the analysis are presented in an analysis window and selectively can be displayed graphically.

The optimization mode provides for determining the best set of design parameters that satisfy specified performance requirements and resource constraints while optimizing a ground combat vehicle's combat effectiveness as measured, for example, by loss exchange ratio computations. A user can select which design parameters will be included in the optimization. These selections are used to configure the control system 50 to optimize combat effectiveness by varying the selected design parameters and satisfying the resource constraints and performance requirements.

The purpose of the computer system for ground combat vehicles is to design optimal ground combat vehicles, as measured by the vehicles' combat effectiveness and given specified performance requirements, or critical combat effectiveness functional attributes, and constraints for cost and weight. The computer system selectively sends a virtual representation of the weapon system to an accredited GroundWars Combat Effectiveness Model, an ARTQUIK model, or a NATO Reference Mobility Model II (NRMM II) for simulation, without affecting the integrity of these virtual simulation systems. GroundWars is a direct fire force-on-force combat simulation model that can be connected to the virtual simulation system interface 30 via GroundWars' data arrays or its input file structure. Because of the complexities in writing to GroundWars input files, the ground combat vehicle embodiment uses data arrays to pass data and information to GroundWars. ARTQUIK is a simple artillery barrage effectiveness model, and NRMM II is a model that evaluates vehicle mobility across different types of terrain. Those skilled in the art are aware that other virtual simulation systems may be available presently and in the future, including proprietary virtual environment software.

Figure 3A:
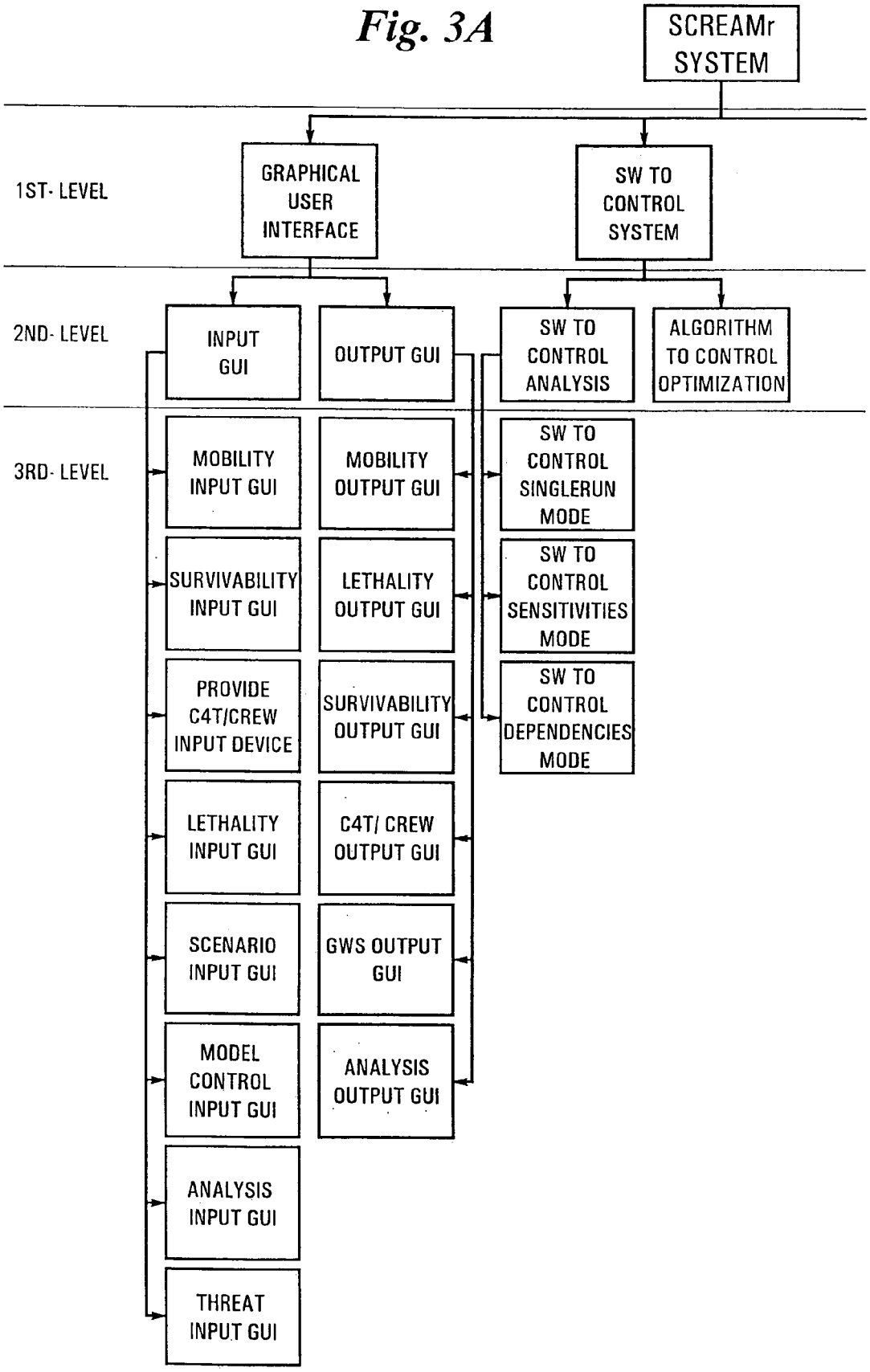
FIG. 3 is a depiction of the components of the system architecture of the preferred embodiment.
Figure 3B:
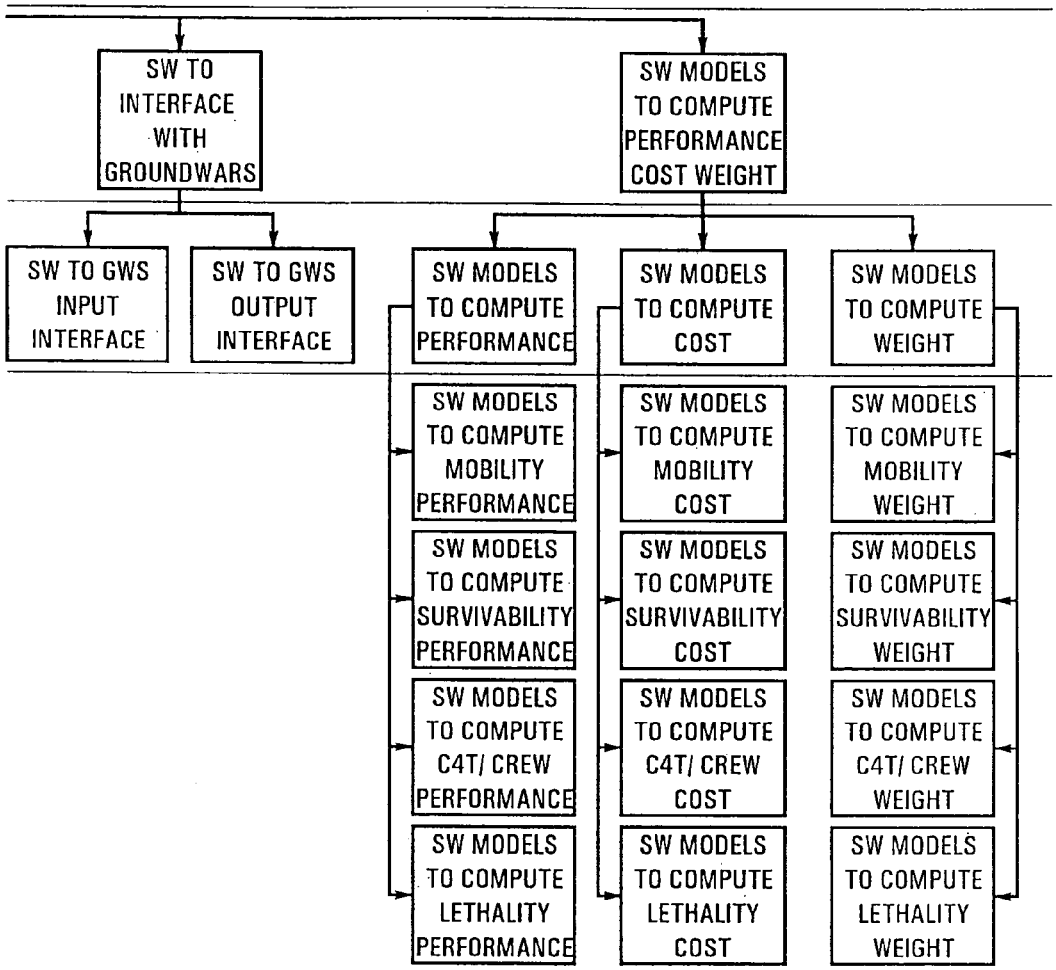

The computer system for a ground combat vehicle implements a modular software architecture down to the vehicle component level. FIG. 3 depicts a breakdown of a ground combat vehicle weapon system. The first level illustrates the primary parts of the computer system, the graphical user interface, software to the control system, software to interface with a virtual simulation system, and models to compute performance, cost, and weight. The second level defines the functional categories of these various parts and shows the part to which each category relates. Input graphical user interface and output graphical user interface are part of graphical user interface. Software to control analysis and algorithms to control optimization are part of software to the control system. Software for input interfaces and software for output interfaces with various particular virtual simulation systems 60 is part of the software to interface with a virtual simulation system. Software models to compute performance, software models to compute cost, and software models to compute weight are part of the software models to compute performance, cost, and weight. The third level provides further detail with respect to each functional category. Input graphical user interface is further broken down into mobility input graphical user interface, survivability input graphical user interface, C4I/crew input graphical user interface, lethality input graphical user interface, scenario input graphical user interface, model control input graphical user interface, analysis input graphical user interface, and threat input graphical user interface. Output graphical user interface is broken down into mobility output graphical user interface, lethality output graphical user interface, survivability output graphical user interface, C4I/crew output graphical user interface, output graphical user interface for various virtual simulation systems, and analysis output graphical user interface. Software to control analysis is broken down into software to control the single run mode, software to control the sensitivities mode, and software to control the dependencies mode. Software models to compute performance are broken down into software models to compute mobility performance, software models to compute survivability performance, software models to compute C4I/crew performance, and software models to compute lethality performance. Software models to compute cost are broken down into software models to compute mobility cost, software models to compute survivability cost, software models to compute C4I/crew cost, and software models to compute lethality cost. Software models to compute weight are broken down into software models to compute mobility weight, software models to compute survivability weight, software models to compute C4I/crew weight, and software models to compute lethality weight.

The computational speed of the computer system is defined for each mode of operation. For the single-run mode, which involves propagating all inputs once through the causal network model and into the virtual simulation system, run times of 2 minutes or less are required. For the dependencies mode, run times of less than 10 seconds are required. For the sensitivities mode, 15 seconds or less is required for nonGroundWars runs that consist of at least 10 increments of the independent variables. For GroundWars runs, 20 minutes or less is required for sensitivities that consist of at least 10 increments of the independent variables. For the optimization mode, run times of 2 days or less are acceptable.

Output from a causal network model run preferably includes information to create a two- or three-dimensional visual prototype of the shape of a resulting ground combat vehicle virtual representation, and information about munitions and mobility as well as an overall system summary, accuracy related performance data, exterior ballistics related performance data, a "blue" vehicle's probability of achieving a hit or killing a "red" vehicle, and a "blue" vehicle's vulnerability to being hit or killed. Output from a GroundWars simulation includes a summary of the results of a monte-carlo style simulation, vehicle acquisition statistics, a killer-victim scoreboard, a distribution of shots, and a loss exchange ratio. This information is available both from the graphical user interface and from the command line. The computational error of the ground combat vehicle embodiment's output preferably does not exceed ten percent for any single variable computed, when compared to actual test data.

Figure 4:
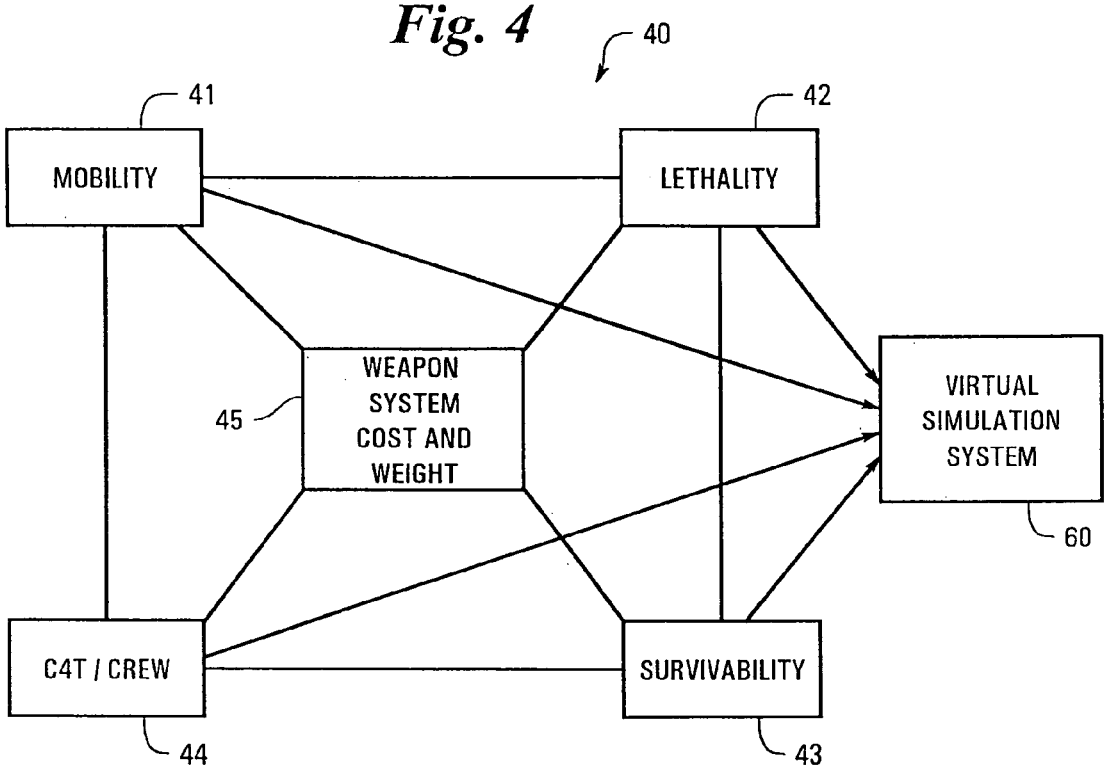
FIG. 4 is a depiction of the causal network model of the preferred embodiment as it is organized around the critical attributes of a ground combat vehicle.

As depicted in FIG. 4, the causal network model is implemented around the four functional cornerstones or performance requirements for a ground combat vehicle: mobility 41, lethality 42, survivability 43, and C4I/Crew 44. The mobility cornerstone 41 contains all operational, system, subsystem, and component level performance and design attributes associated with transporting the vehicle through the United States Army's air, rail, road, and sea transportation network, and the vehicle's mobility, under its own power, across prepared roads and cross-country. The lethality cornerstone 42 contains all operational, system, subsystem, and component level performance and design attributes associated with storing, loading, aiming, firing, flying, and penetrating a target with a long rod penetrator. The survivability cornerstone 43 contains all operational, system, subsystem, and component level performance and design attributes associated with not being seen, not being hit, and not being killed. The C4I/Crew 44 cornerstone contains all operational, system, subsystem, and component level performance and design attributes associated with target search, acquisition, engagement timeliness, and engagement doctrine. The causal network model may be further disseminated to capture subsystem and component level resolution. Using this as a basis, the causal network model calculates, for example, the size and mass of a vehicle, the location of the vehicle's center of gravity, the vehicle's moments of inertia, the maximum speed of the vehicle, the vehicle's minimum potential shooting frequency, and the speed of a projectile as it leaves the vehicle's gun barrel.

The operations simulator interface is designed to act as a conduit between the causal network model and the Army's GroundWars model, thereby preserving GroundWar's accredited status. The detailed design of the operations simulation interface includes data structure packets for distributing to the GroundWars simulator the performance parameters necessary for GroundWars operation. These data structures have been structured according to the four functional cornerstones of ground combat vehicles. With respect to mobility, data regarding cross country speed, acceleration, deceleration, gross vehicle weight, maximum pressure, vehicle height, vehicle length, and vehicle width have been bundled. With respect to lethality, data regarding maximum engagement range, rate of fire, rounds on board, time-of-flight, probability of hit, probability of kill, vehicle length, and vehicle width have been bundled. With respect to survivability, data regarding probability of not being detected, probability of not being hit, probability of not being killed, active protection system effectiveness, and CM effectiveness have been bundled. With respect to C4I/crew, data regarding search volume rate, probability of detection, and time to acquire, identify, and engage have been bundled. In addition, the operations simulation interface returns data structures from GroundWars to the control system and user interface.

Figure 5:
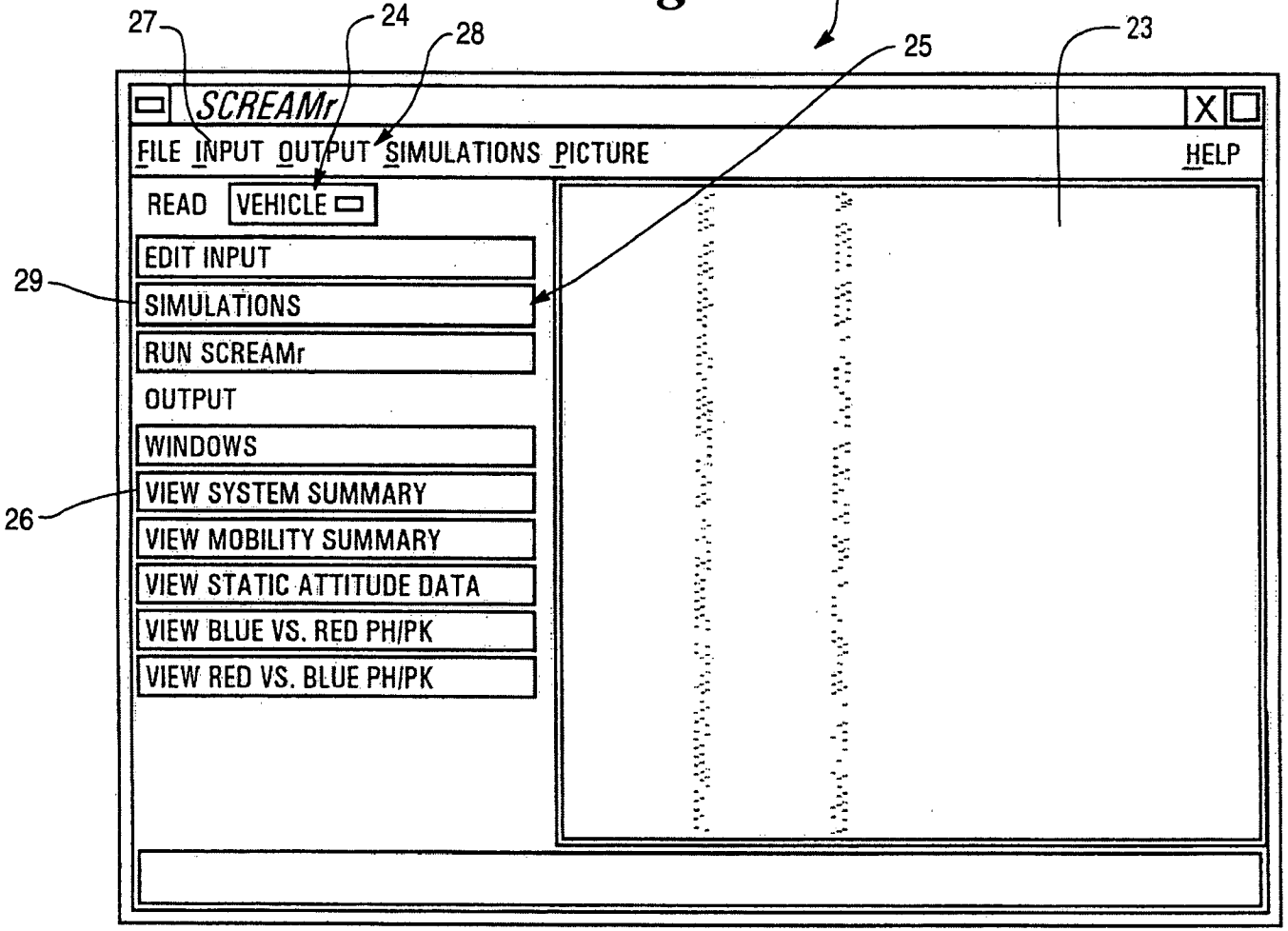
FIG. 5 is an illustration of the main menu window.
Figure 6:
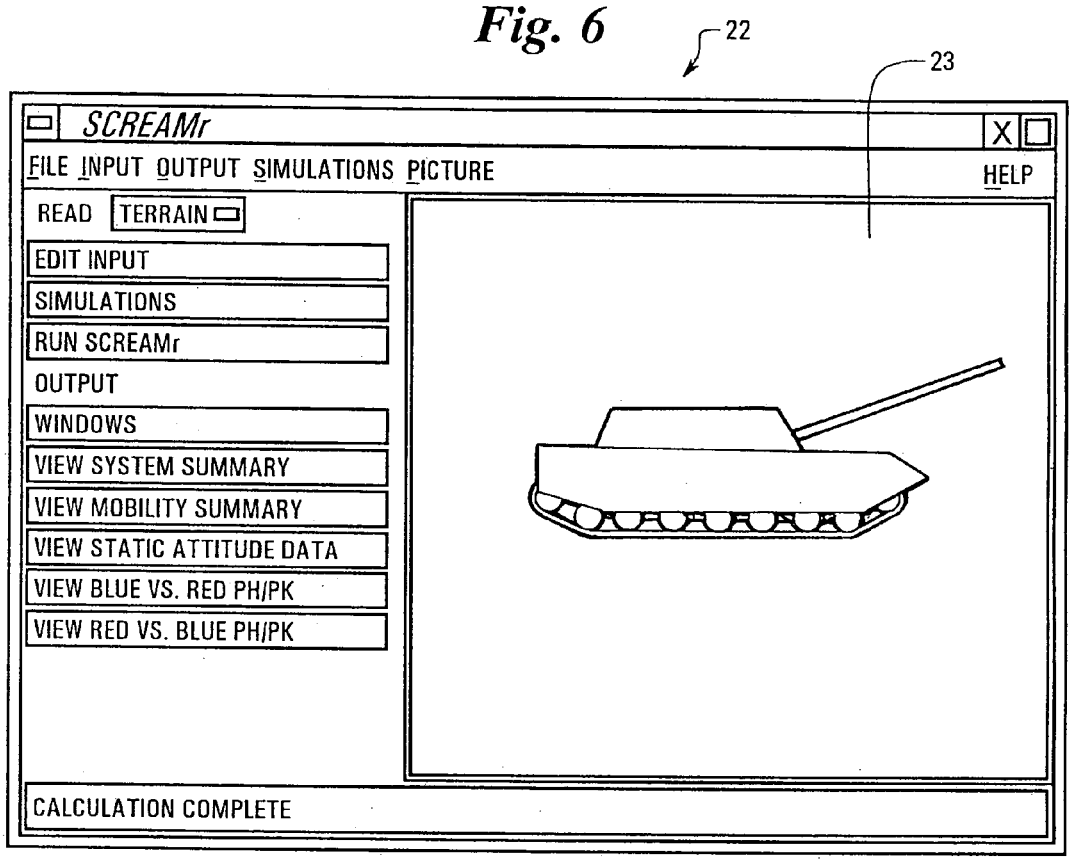
FIG. 6 is an illustration of the main menu window demonstrating the quickview window feature.

As those skilled in the art are aware, a multitude of graphical user interface designs are possible for inputting data and presenting resulting information. FIGS. 5 through 12 depict several of the windows used in the ground combat vehicle embodiment. Of particular significance is the main menu window 22 illustrated in FIG. 5. The main menu window 22 provides the button for selecting the mode of operation 29 and the button for starting a simulation 25. The main menu window 22 also provides a quickview window feature 23. As shown in FIG. 6, the quickview window 23 preferably displays a three-dimensional visual prototype of a vehicle virtual representation upon completion of a successful run by the causal network model. The three-dimensional visual prototype can be viewed from different perspectives using a mouse. Clicking and holding the center mouse button with the pointer on the quickview window 23 causes the three-dimensional visual prototype to zoom in and out. Clicking and holding the right mouse button with the pointer on the quickview window 23 causes the three-dimensional visual prototype to rotate. Double clicking on the quickview window 23 creates a new window next to the previous window, which new window stays intact until it is closed.

The causal network model, controller system, and the virtual simulation system interface integrally comprise what is referred to as the computational engine of the ground combat vehicle embodiment. The computational engine calculates the dependent parameters of a vehicle design given specified input parameters. The computational engine accepts input from ASCII text input files, calculates the dimensions, mass, and locations of the components, determines the size and mass of the overall vehicle, and calculates ballistic and mobility performance information. The computational engine also selectively runs GroundWars, NRMM II, ARTQUIK, or other virtual simulation systems. For output, the computational engine preferably produces a set of files that contains all the calculated information about a vehicle and its performance, and produces a high-level system summary output file and a quickview file that can be used by the quickview window 23.

Figures 12, 13:
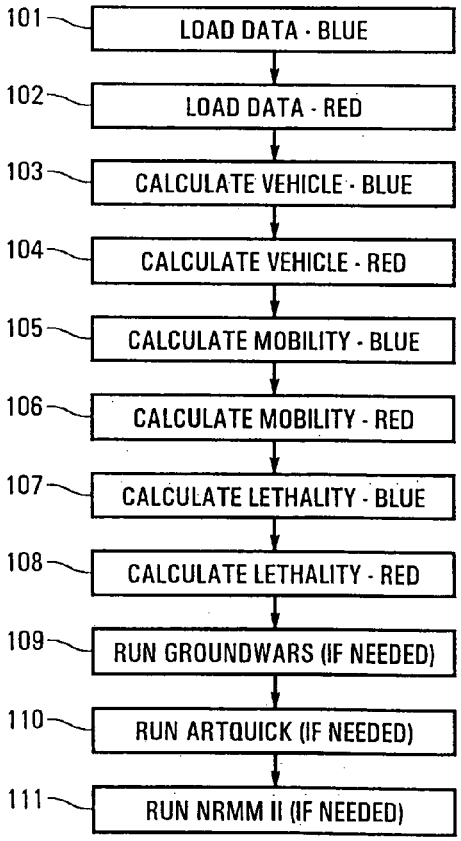
FIG. 13 is a diagram of the algorithm for the computational engine of the preferred embodiment.

FIG. 13 illustrates an overall algorithm for the computational engine software. This algorithm is repeated each time the binary executable for the engine is run. Calculations for both a "blue" vehicle, the vehicle under consideration, and a "red" vehicle, the "threat" vehicle, are performed in the same way. They are both built from identically formatted input and both virtual representations use the same methods, so those skilled in the art are aware that the data loading and the calculations steps may be completed in other logical orders.

The text input files for a blue vehicle are written by either a user or the graphics user interface. The input files for a red vehicle are divided into a plurality of subdirectories, one for each threat vehicle available. For example, files are kept for the T55-type MBT, the T72-type MBT, the T90-type MBT, the Infantry Fighting Vehicle, and a supertank MBT. The Load Data—Blue 101 step loads the blue vehicle input files, and the Load Data—Red 102 step loads a set of red input files based on a user's selection. Input files include the following files: for ammunition, including information about the projectile and the propelling charge; for armor for the hull excluding the turret; for ARTQUIK, scenario information for running the ARTQUIK model; for the cannon or a vehicle's main gun; for crew systems, including information about passengers such as how much space they use and how much they weigh; for the environment in which the vehicle is analyzed, including information such as air temperature and density and terrain for running GroundWars scenarios; for vehicle fire control parameters; for information about a GroundWars scenario, such as how many platforms are on each side and what posture they are in; for any missiles a vehicle carries in addition to its main gun; for telling NRMM II whether to run or not; for details about a pulse forming network with respect to a vehicle with an electro-thermal gun; for powertrain and other information about the engine and related components; for information about tracked suspension components; for information about wheeled suspension components; for describing the type of threat vehicle; for information about transportability constraints to which a vehicle is subject; for turret, including information about the vehicle turret, the turret armor, and elevation and depression of the gun; and for vehicle, including information about the vehicle layout such as the number of crew, where the crew sits, and the location of major components such as the powerplant, turret, and magazine.

Figure 14:
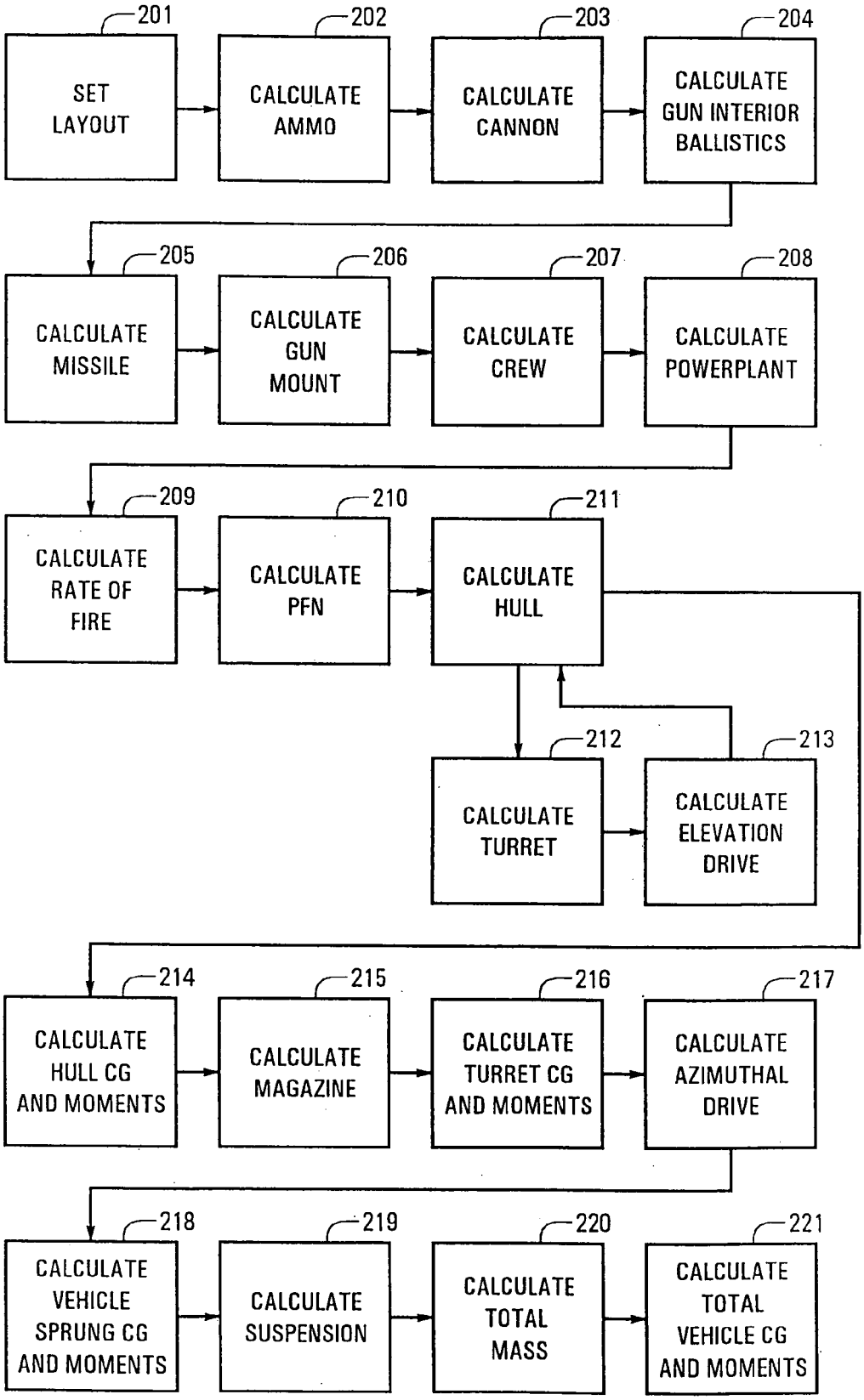
FIG. 14 is a diagram of the algorithm for calculating the parameters of a ground combat vehicle.

FIGS. 13 and 14 illustrate a step 103, calculate vehicle—blue, and a step 104, calculate vehicle—red, or the process by which a vehicle is calculated. Steps 202, 203, 205–208, 210—213, 215, 217, and 219 represent calculations for individual vehicle components. The other steps represent calculations for component properties or properties of the overall vehicle. Step 201, set layout, establishes the layout of the vehicle. This includes determining the number of crew and where each crewmember is located, whether the engine is in the front or in the rear of the vehicle, whether the turret is in the mid or rear compartment of the vehicle, whether the ready magazine is located above or below the turret ring, and where any missiles are located. The algorithm that executes this step has internal logic that allows it to rule out any layouts the model cannot currently handle. For example, the engine and the turret cannot be in the same location. Step 202, calculate ammo, is the first component calculation. The size of the ammunition is calculated before anything else since the size of a cannon is dependant on the size of the ammunition and the cannon size greatly influences the overall size of the vehicle. This step includes calculating the lethal area. Step 203, calculate cannon, involves sizing a main gun based on the inputs for shot travel and maximum chamber pressure attained by the ammunition. The gun may be either autofrettaged or monoblock. Calculations are completed for both cases, and a monoblock gun is selected if it is less than 120% of the mass of an autofrettaged gun. Outputs from this calculation include the mass, length, radii of the barrel sections, moments of inertia, and center of mass of the cannon. Calculations of the ammunition and cannon properties generally are run prior to the interior ballistics function, and the interior ballistics function is completed before the gun mount is sized. Step 204, calculate gun interior ballistics, calculates the muzzle velocity of both a HE (high explosive) round and a APFSDS (armor piercing fin stabilized discarding sabot) round fired by the main gun. If the vehicle has missiles, step 205, calculate missile, calculates the size of the missile canister as well as performance parameters such as the average velocity of the missile. Step 206, calculate gun mount, involves calculating the dimensions and mass of a gun mount, which is a function of the chamber diameter of the cannon. The dimensions of the gun mount will in turn influence the geometry of a turret. Step 207, calculate crew, involves calculating the volume taken up by each crewmember and the center of mass of each crewmember. The overall dimensions and overall mass of the crewmembers are user inputs. Based on the engine and transmission type and other user input about the powertrain, the most critical of which is the engine horsepower, step 208, calculate powerplant, calculates the overall mass and volume claim of the powerplant. Based on the ammunition properties and the vehicle layout, step 209, calculate rate of fire, calculates the rate of fire of the main gun. The gun is assumed to be loaded automatically if there are two or fewer crew located in the turret; if there are three or more crew located in the turret, one of those crew is assumed to be a loader, and the gun is manually loaded. If the main gun is an electro-thermal chemical gun, the size and mass of the associated pulse forming network are calculated in step 210, calculate PFN. The size and shape of the hull can then be calculated in step 211, calculate hull. The height of the hull may be influenced by some or all of the following factors: the height allowed for crew members in the hull, the minimum linear dimension of the powertrain components, the length of recoil of the cannon at maximum elevation, and the size of the ammunition. Once the height of the hull is fixed, it is possible to calculate the size of the turret. The turret basket radius, that part of the turret below the upper deck of the hull, may strongly influence the overall width and length of the hull. The calculation of the hull is temporarily suspended while step 212, calculate turret, is undertaken. Further, step 213, calculate elevation drive, is needed to complete the calculation of the turret. Once the size of the turret is determined, calculation of the size and mass of the hull can be completed. At this point it is possible to calculate the center of gravity and moments of inertia of the hull structure in step 214, calculate hull center of gravity and moments.

Step 215, calculate magazine, is used to determine the mass of the ready magazine. The dimensions of the magazine have already been calculated, as part of the turret. This may include a calculation for an autoloader, if present. Then it is possible to calculate the center of gravity and moments of inertia of the turret in step 216, turret center of gravity and moments. This includes all components that are fixed to and rotate with the turret, including crew members in the turret, the ready magazine, the main gun, the elevation drive, and the gun mount. Having calculated the azimuthal moment of inertia of the turret, it is possible to size the turret azimuthal drive in step 217, calculate azimuthal drive. In step 218, calculate vehicle sprung center of gravity and moments, the combined center of mass and moments of inertia of the entire sprung part of the vehicle, everything but the suspension, is calculated. This includes the turret, the hull structure, and all hull interior components. The calculation for suspension, whether wheeled or tracked, is performed in step 219, calculate suspension. This includes not just the mass of the suspension but also its vehicle dynamic properties. It is then possible to calculate the overall vehicle mass in step 220, calculate total mass, and calculate the center of mass and moments of inertia of the entire vehicle, including both sprung and unsprung parts, in step 221, calculate total vehicle center of gravity and moments.

Figure 15:
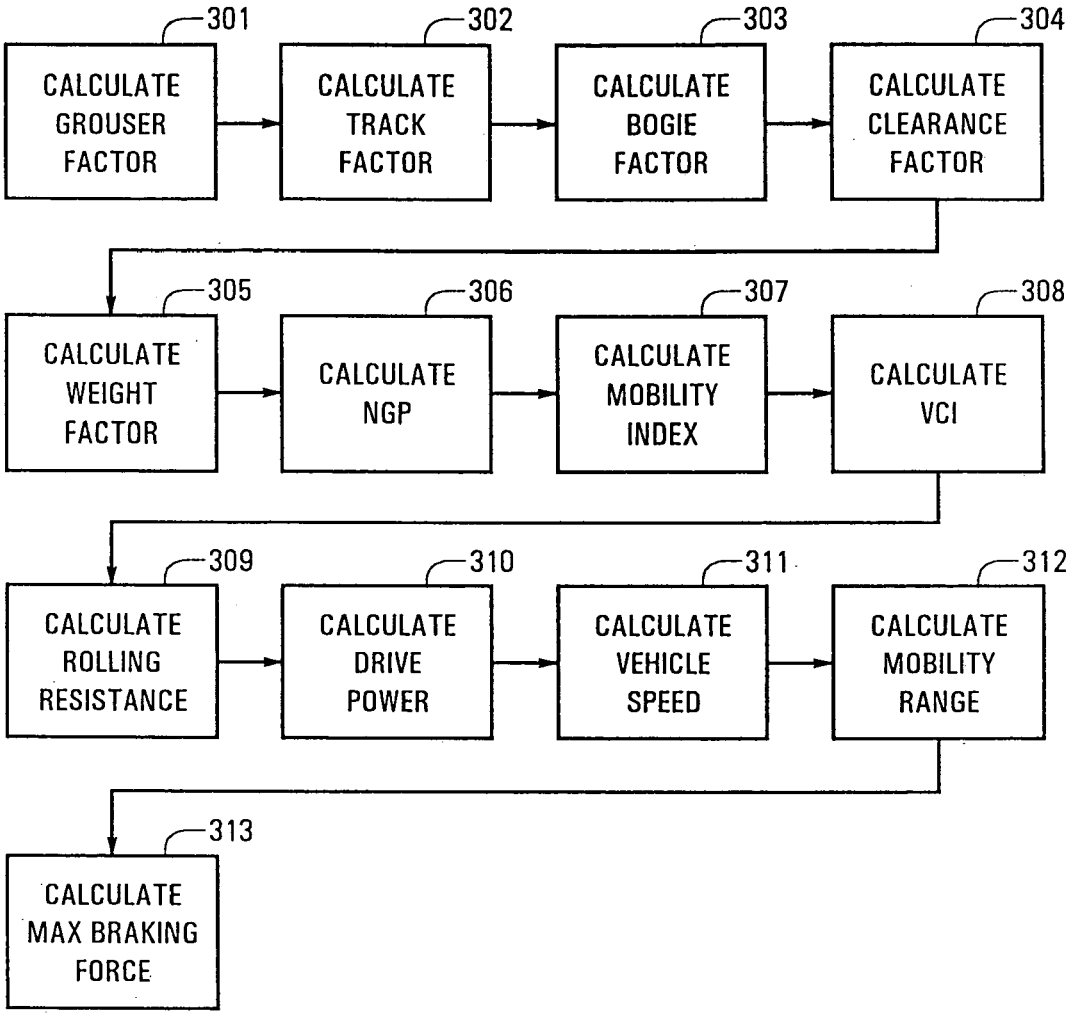
FIG. 15 is a diagram of the algorithm for calculating the vehicle mobility performance of a ground combat vehicle.

FIG. 15 illustrates a calculation of vehicle mobility performance parameters or the process by which the vehicle mobility performance is calculated. Step 301, calculate grouser factor; step 320, calculate track factor; step 303, transmission factor; step 304, calculate bogie factor; step 305, calculate clearance factor; step 306, calculate weight factor; and step 307, calculate nominal ground pressure, are all used in calculating the mobility index. The grouser factor takes on discreet values depending upon the running gear characteristics. The track factor, used only for tracked vehicles, is equal to the track width divided by 100; the transmission factor takes on a value of 1 for a hydraulic transmission and 1.05 for a mechanical transmission; and the bogie factor, also used only for tracked vehicles, is calculated by taking 10% of the weight of the vehicle, in pounds, and dividing by the track shoe areas and the total number of road wheels. The clearance factor is calculated by taking the vehicle ground clearance, in inches, and dividing by ten. The weight factor takes on discreet values based on the weight of the vehicle, and the nominal ground pressure, and preferably is used only for tracked vehicles. The weight factor is the average pressure applied to the soil by the vehicle, or the total weight divided by the total track area. The mobility index is then calculated in step 308, calculate mobility index, for use in calculating the vehicle cone index.

Step 309, calculate vehicle cone index, calculates an empirical formula that uses the mobility index. The vehicle cone index is used in the vehicle's rolling resistance calculation. Step 310, calculate rolling resistance, calculates the rolling resistance measure of the power required to overcome the internal resistance of the tracks and wheels and effects produced by their motion through the soil, measured in Hp/ton. Road values for tracked vehicles use a velocity dependent empirical expression that is incorporated into the speed calculation. The power which can be supplied to the sprocket (wheels) to propel a vehicle is calculated in step 311, calculate drive power. It is based on the prime power, cooling, and transmission efficiencies; thermal load; and required armament power. Step 312, calculate vehicle speed; step 313, calculate mobility range; and step 314, the calculate max braking force, respectively calculate the maximum vehicle speed given the available drive power, accounting for drag and rolling resistance; the maximum range that a vehicle can travel with a specified fuel supply at maximum velocity; and braking force based on an empirical relationship between braking force and mass for braking from 60 mph to 0 mph in 3 seconds.

Figure 16:
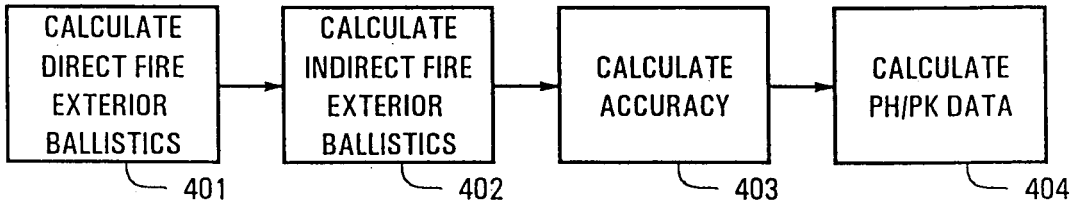
FIG. 16 is a diagram of the algorithm for calculating the vehicle lethality performance of a ground combat vehicle.

FIG. 16 illustrates a calculation of vehicle lethality performance parameters or the process by which the vehicle lethality performance is calculated. Lethality data is calculated subsequent to mobility data, because the maximum speeds of both the firing and the target platforms should be known before accuracy calculations can be made. Step 401, calculate direct fire exterior ballistics, based on calculated muzzle velocity, flight characteristics of the direct fire projectile, presumed to be a long rod penetrator, and atmospheric properties, calculates a set of direct fire ballistic data for range increments from 500 m to 8000 m. This step includes calculations for trajectory, time of flight, and velocity at impact. It also calculates the various unit effects for each trajectory, which are partial derivatives that measure the change in ballistic parameters given a small change in firing conditions such as change in range given a small change in cannon quadrant elevation. Given the muzzle velocity and maximum cannon elevation, a step 402, calculate indirect fire exterior ballistics, calculates the maximum range attained by the indirect fire, or high explosive, projectile. Based upon the unit effects data calculated as part of the direct fire exterior ballistics step, combined with the fire control data input, step 403, calculate accuracy, calculates the random and variable elevation and azimuthal dispersions, measured in mils, for range increments from 500 m to 8000 m. This calculation is done for each of the four possible firer-target relative motion conditions, wherein the firer and the target are either stationary or moving. For each firer-target relative motion condition, step 404, calculate ph/pk, calculates a set of probability of hit and probability of kill data. This data is based upon the dispersions calculated in the previous step. For a blue vehicle, the ph/pk data is evaluated with respect to the selected red or threat vehicle. Additionally, ph/pk data is calculated for a red vehicle with a blue vehicle as the target, that can be interpreted as vulnerability information for a blue vehicle.

With the above information calculated, a user can elect to run the GroundWars, ARTQUIK, or the NRMM II simulation models or systems in steps 109, 110, and 111. The measure of effectiveness in ARTQUIK is the number of rounds required to achieve the desired effect. If the vehicle does not carry enough ammunition to carry out the specified mission, the ground combat vehicle embodiment will report that the desired effect is unachievable. ARTQUIK is automatically run if the blue vehicle is carrying any high explosives type rounds on board.

As an example application of the integrated evaluation and simulation system via the graphical user interface windows, a default vehicle can be called up and processed by the computational engine. Changes then can be made to the vehicle inputs and simulations can be run. The computer system is first compiled and then initiated to execute the binary to implement the graphical user interface windows or panels. A default vehicle is then selected by clicking on the Default File Set button 24 on the main menu window, as shown in FIG. 5.

Figure 10:
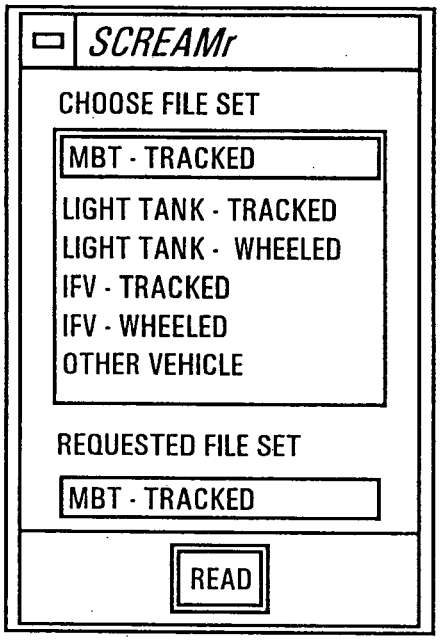
Figure 10A:
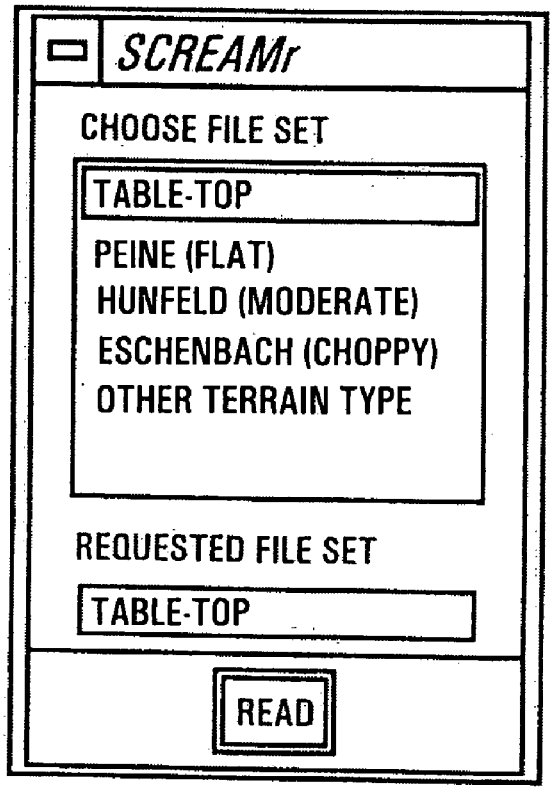

This will bring up a menu with selections VEHICLE, THREAT, and TERRAIN. Selecting VEHICLE, a window will appear as shown in FIG. 10 that is a list of the vehicles available as defaults. Often, it is more convenient to modify one of the default vehicles than it is to populate each and every input window from scratch. A default vehicle is selected and a READ button is clicked to populate all of the input windows for the default vehicle. A default terrain can be selected by clicking on the Default File Set button 24 again and selecting TERRAIN. It is important to pick a terrain, because otherwise atmospheric properties such as density and pressure will be assumed to be zero, which will significantly affect the exterior ballistic routines. A list of the terrains which are available as defaults appears as shown in FIG. 10A. The distinction between FLAT, MODERATE, CHOPPY, and TABLE-TOP is important only if a GroundWars scenario is being played. Assume that TABLE-TOP is selected and the READ button is clicked.

Figure 7:
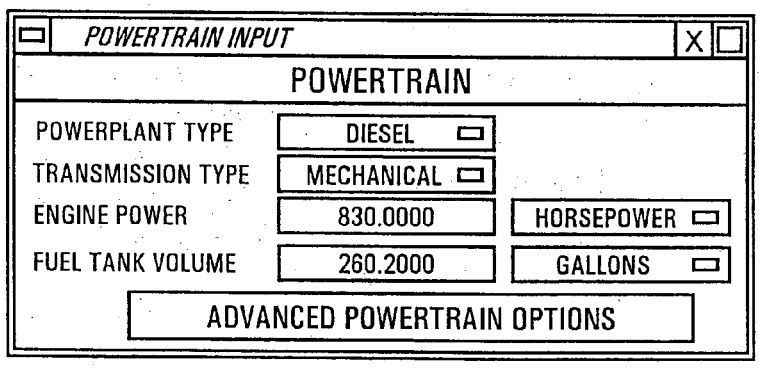
FIGS. 7 through 12 are illustrations of various menu windows of one embodiment relating to ground combat vehicles.
Figure 8:
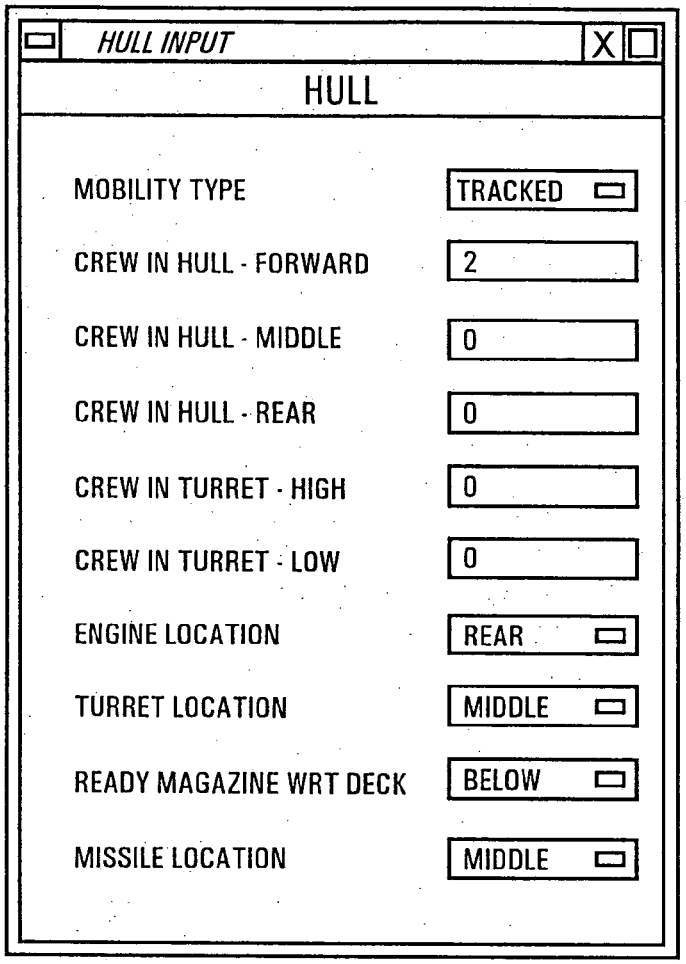
Figure 9:
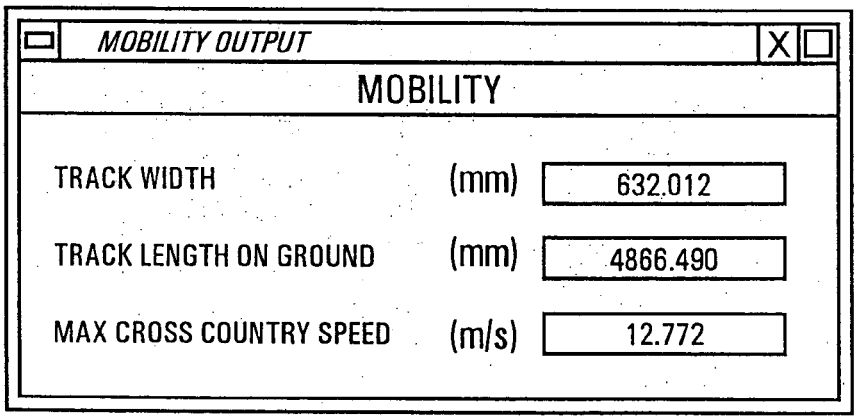

To look at some of the input data, INPUT 27 on the main menu window and then Powertrain are selected. The main Powerplant input window appears as shown in FIG. 7 to display critical information about the vehicle powerplant. The data fields are populated with nonzero values because the default vehicle from the Default File Set Menu shown in FIG. 10 was selected. If this window had been opened before selecting a default vehicle, the Engine Power and Fuel Tank Volume would both be set to 0.000, and Powerplant and Transmission would be set to their default values. Clicking on the box in the upper left of the panel and selecting CLOSE will close the Powerplant input window. To run the computerized engine, the RUN button 25, which is located in the column to the left of the quickview window 23 on the main menu window, as shown in FIG. 5, is selected. The graphical user interface program takes all of the data in the graphical user interface input windows and writes a set of text files to the input directory. The graphical user interface program then calls the computational engine to read the text files in the input directory and calculate everything it can about the combat vehicle in question, including its mass and mass properties, its dimensions, its baseline ballistics, and its mobility performance data. A series of graphical user interface output files are written as well as are other text output files and a quickview file. The RUN button grays out while the computational engine is running. Once the computational engine is finished, the button returns to normal, an updated quickview picture of the vehicle is shown in the quickview window 23 on the main menu, and the message "Calculation Complete" appears in the lower left corner of the window.

To look at some output, the button VIEW System Summary on the main menu 26, located to the left of the quickview window 23, under the section labeled OUTPUT is selected. This will call up a window to view the file system summary. This file gives a summary of the critical information about the system. It echoes back some inputs, such as the suspension type and number of crew, and also reports outputs, such as the mass and dimensions of the vehicle, a mass breakdown by individual components, and information about the gun and ammunition. Another way to view output data is by selecting the OUTPUT menu 28 on the Menu Bar of the main menu window and selecting Mobility. When a change is made to vehicle input and the computational engine is rerun, the data in the mobility window is updated to reflect the changes to the vehicle.

Figure 11:
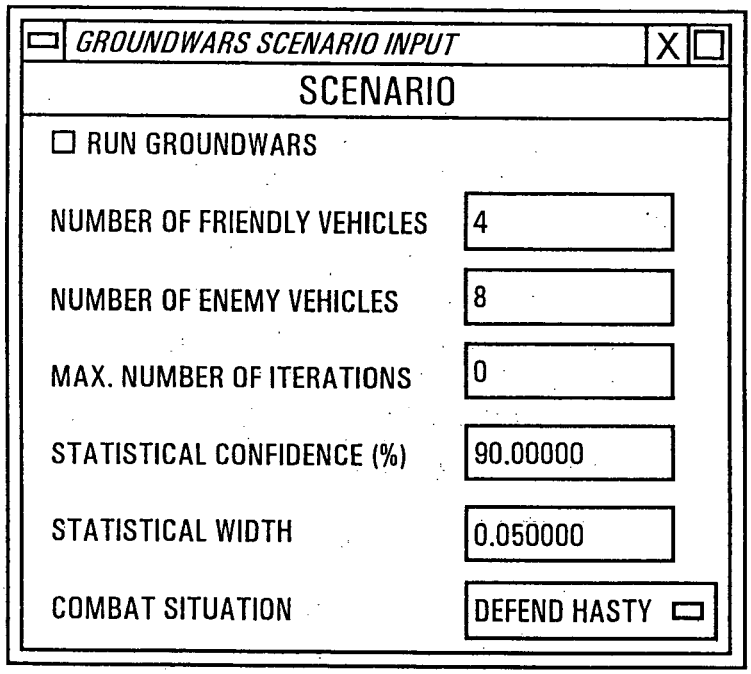

To run a GroundWars simulation in a direct fire engagement, the Simulations menu 29 is opened on the main menu window, and the GroundWars window is selected as shown in FIG. 11. The GroundWars box in the upper left is checked and then the Maximum Number of Iterations is set. Selecting the RUN button 25 on the main menu window will cause the computational engine to reprocess the input; when the computational engine is done calculating the vehicle, a GroundWars simulation will run in which 4 blue vehicles will fight 8 red vehicles. The Combat Situation, Defend Hasty, indicates that the blue force is defending in a "hasty" position, e.g., they are filly exposed rather than hull down. When the program is done running, opening up the GroundWars Output Window, which is located under the Output pulldown menu 28 on the main menu, will display results of the GroundWars engagement, expressed in terms of a Force Exchange Ratio and a Loss Exchange Ratio. The Loss Exchange Ratio is the ratio of Red Vehicles Killed to Blue Vehicles Killed. The Force Exchange Ratio is the Loss Exchange Ratio divided by the initial ratio of red vehicles to blue vehicles.

To change a vehicle layout, and hopefully improve the vehicle's performance in direct fire engagement as measured by the Loss Exchange Ratio, under the Input pulldown 27 on the main menu, the Hull window is selected. Once all the changes are made in the Hull window, the RUN button 25 on the main menu is selected once again. As before, the computational engine will calculate the properties of this new system; it will also run the exact same GroundWars scenario as before. When the computational engine is done running, the shape of the new vehicle system should appear in the quickview window 23 on the main menu window.

The vehicle in the quickview window 23 can be viewed from different perspectives using a mouse. By clicking and holding the center mouse button with the mouse pointer on the quickview window 23, the view zooms in and out. By clicking and holding the right mouse button with the mouse pointer on the quickview window 23, the vehicle rotates. Double clicking the quickview window 23 creates a new window off to the side, which stays intact from run to run until it is closed. This allows vehicles from different runs to be compared side by side.

Although the preferred embodiment of the integrated evaluation and simulation system for ground combat vehicles has been described herein, it should be recognized that numerous changes and variations can be made and that the scope of the present invention is to be defined by the claims.

What is claimed is:

1. An integrated evaluation and simulation system for a ground combat vehicle, comprising:

a computer system programmed to implement a computational engine factoring at least one interrelationship among a plurality or critical combat effectiveness functional attributes and constrained resources for the ground combat vehicle, and to create an optimally combat effective virtual representation of the ground combat vehicle, wherein the computational engine has a modular software architecture down to a vehicle component level, wherein the modular software architecture has a plurality of modules wherein each module is represented by a separate subroutine including:

a first level, a second level, and a third level of categorizing subroutines;

whereby the first level categorizes subroutines by primary parts of the computer system and wherein the second level defines funtional categories of the parts;

at least one virtual simulation system operatively coupled to the computational engine for simulating the ground combat vehicle; and a user interface operatively coupled to at least the computer system for selectively inputting data into the computational engine and receiving information from the computational engine and the virtual simulation system;

wherein the categories of the first level are graphical user interface, software for a control system, software to interface with a virtual simulation system, and models to compute performance, cost, and weight; wherein graphical user interface is subcategorized into the second level categories of input graphical user interface and output graphical user interface; and wherein software, software for the control system is subcategorized into the second level categories of software to control analysis and algorithms to control optimization; wherein software to interface with a virtual simulation system is subcategozized into the second level categories of software for input interfaces and software for output interfaces, and wherein software models to compute performance, cost, and weight is subcategorized into the second level categories of software models to compute performance, software models to compute cost, and software models to compute weight; and wherein the second levele category of input graphical user interface is further subeategorized into the third level categories of mobility input graphical user interface, survivability input graphical user interface, C4I/crew input graphical user interface, lethality input graphical user interface, scenario input graphical user interface, model control input graphical user interface, analysis input graphical user interface, and threat input graphical user interface, wherein the second level category of output graphical user interface is further subeategorized into the third level categories of mobility output graphical user interface, lethality output graphical user interface, survivability output graphical user interface, C4I/crew output graphical user interface, output graphical user interface for various virtual simulation systems, and analysis output graphical user interface, and wherein the second level category of softwear to control analysis is further subcategorized into the third level categories of software to control a single run mode, software to control a sensitivities mode, and software to control a dependencies mode.

* * * * *